United States Patent [19]

Kramer

[11] Patent Number: 4,515,244

[45] Date of Patent: May 7, 1985

[54] DIRECTION ALTERING DEVICE

[76] Inventor: Edward T. Kramer, R.D.-1, Box 401, Ashland, Pa. 17921

[21] Appl. No.: 593,113

[22] Filed: Mar. 26, 1984

[51] Int. Cl.[3] ..... A62B 1/20

[52] U.S. Cl. ..... 182/230; 182/2; 182/100; 182/190; 24/129 R

[58] Field of Search ..... 24/129 R, 115 R, 115 M, 24/133; 182/3, 100, 190, 2, 230

[56] References Cited

U.S. PATENT DOCUMENTS

| | | | |
|---|---|---|---|
| 195,161 | 9/1877 | Philbrook | 182/190 |
| 645,677 | 3/1900 | Wingert | 182/190 |
| 646,882 | 4/1900 | Snyder | 24/115 R |
| 727,980 | 5/1903 | Lloyd | 24/115 R |
| 1,692,640 | 11/1928 | Erickson | 24/115 R |
| 2,195,299 | 3/1940 | Frankel | 182/3 |
| 2,904,303 | 9/1959 | Gentline | 248/499 |
| 3,871,480 | 3/1975 | Sauri | 182/142 |
| 4,243,118 | 1/1981 | Landry | 182/3 |

*Primary Examiner*—Reinaldo P. Machado
*Attorney, Agent, or Firm*—William Z. Warren

[57] ABSTRACT

The direction altering device is used in conjunction with an emergency or exit rope or friction type lowering device. The purpose of the device is to hold the exit rope in a fixed position at the point on a bucket of a bucket truck, cherrypicker, or overhead crane, or on a window sill from which the emergency exit is being taken by the user.

The device is clamped onto a surface such as the lip or edge of a bucket, liner, or combination of both, crane surface, or window sill, by placing the device on the said mounting surface so that the mounting surface is inserted into a channel formed on the device; screws mounted in one of the sides of the channel are then tightened to hold the device securely on the surface of the structure from which the descent is to be made. The exit rope is then placed into a slotted hole which is formed in the upper edge of the extension of the base panel of the channel of the device; the exit rope is then prevented from moving in a lateral direction or sliding along the surface from which exit is being taken. The device can be mounted at any point on the mounting surface, so that the exit rope will be securely held at that point.

3 Claims, 9 Drawing Figures

DIRECTION ALTERING DEVICE

BACKGROUND OF THE INVENTION

Public utilities and industrial firms that utilize bucket trucks, cherrypickers, or overhead cranes normally provide an exit rope for the use of the operator in the event of an emergency or power failure of the said truck or crane. In many cases, the operator has suffered severe injuries, while making a descent to the ground, when the rope has slid along the edge of the bucket or other surface from which the exit has been made. The rope has a tendency to slide in a direction toward the point of attachment of the end of the rope to a point where the rope drops off the said bucket or other surface. The operator has then fallen for a distance of as much as six feet before being brought to an abrupt halt and has usually suffered internal and/or spinal injuries, as a result of forces exerted by the safety belt. At times, the rope has been damaged or cut. In some cases, the operator has come into contact with live, current-carrying, electrical wires, as a result of the sliding rope. Similar injuries have occurred, when a person, in attempting to escape from an upper story of a burning building, has used a rope suspended over a window sill.

This device was invented in order to prevent such mishaps and injuries; it holds the exit rope at a fixed position on the surface from which descent to the ground is being made. The device prevents the rope from sliding along the edge of the said surface in a direction towards the point of attachment of the rope, which the rope tends to do when the weight of the person descending is applied to the free end of the rope. The inventor has, therefore, named this invention a "direction altering device". The exiting person may thus descend without being abruptly dropped and may choose any clear straight path to the ground, thereby avoiding wires or any other obstacles. The use of the device, also, prevents the rope from being damaged or cut during the descent.

SUMMARY OF THE INVENTION

The direction altering device of my invention comprises a base panel and two side panels, which together from a channel. Into this channel is placed the surface on which the device is to be mounted. One or more mounting screws in one of the side panels are tightened against the said surface to hold the device tightly on the said surface. On a portion of the base panel, which extends beyond the area of connection of one of the side panels with the said base panel, there is a slotted hole through which a rope or cable may be passed. When the device is thus installed with the rope passing through its slotted hole, the rope is prevented from sliding along the said surface, as weight is applied to the free end of the rope, the other end of the rope being firmly attached to a fixed point.

Other objects and advantages of my invention will become more apparent after a careful study of the following detailed description taken together with the accompanying drawings which illustrate a preferred embodiment of my invention.

DESCRIPTION OF THE PREFERRED EMBODIMENT

Figure 1:
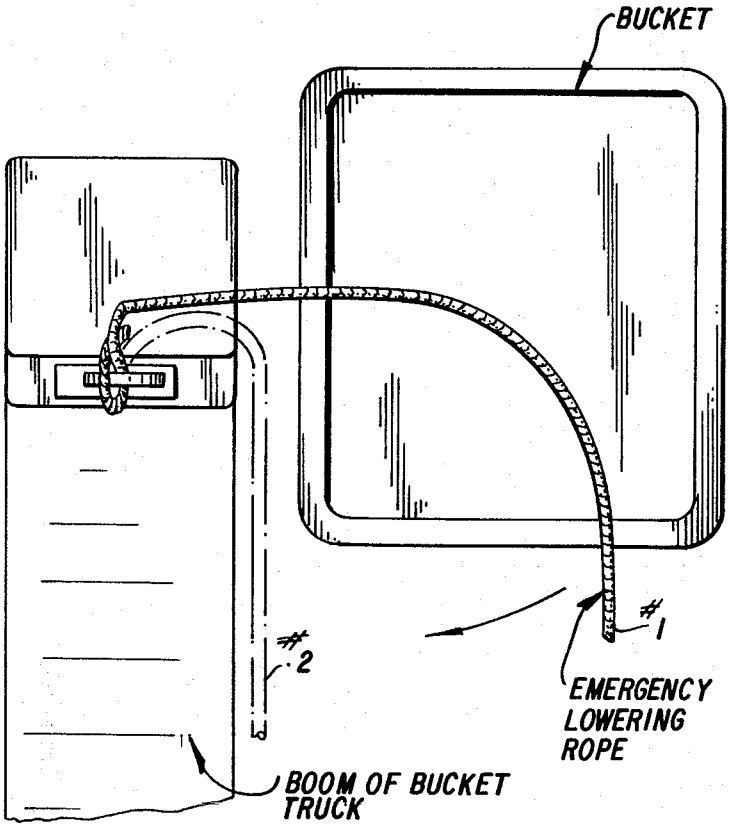
FIG. 1 is a top view of a bucket on a bucket truck, showing the bucket and the boom of the bucket truck, with the emergency lowering rope being utilized without benefit of the direction altering device.
Figure 3:
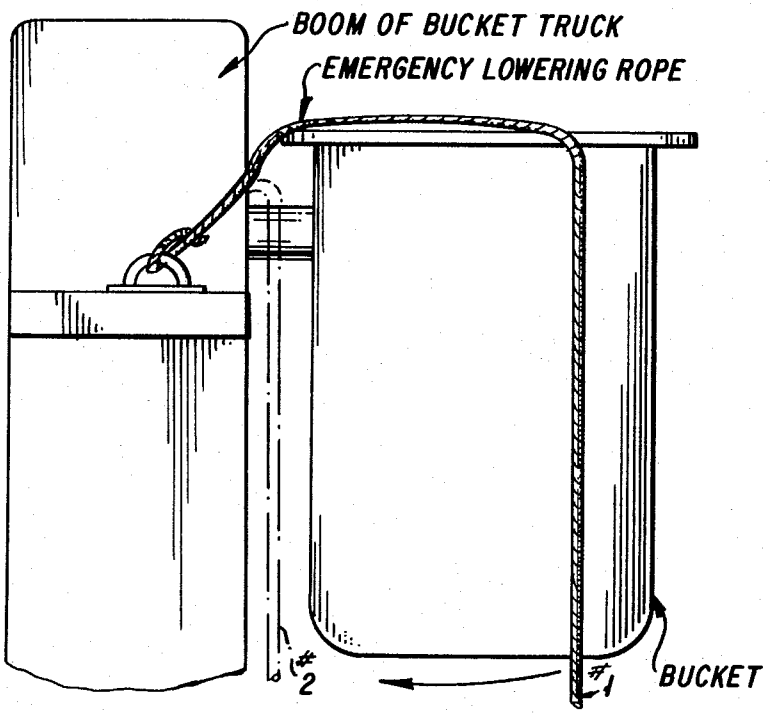
FIG. 3 is a side view of a bucket on a bucket truck, showing the bucket and the boom of the bucket truck, with the emergency lowering rope being utilized without benefit of the direction altering device.

Referring now more particularly to the drawings wherein are illustrated the advantages of and the preferred embodiment of my invention, FIG. 1 and FIG. 3 show that when the emergency lowering rope is positioned on the lip of the bucket at a particular position #1 to avoid obstacles, the rope will tend to slide in the direction indicated by the arrow pointing toward the left and off the edge of the bucket. The rope will then move to position #2, causing the exiting individual to abruptly drop onto the side of the bucket boom or other obstacle, thereby resulting in possible injury to the individual and damage to the rope.

Figure 2:
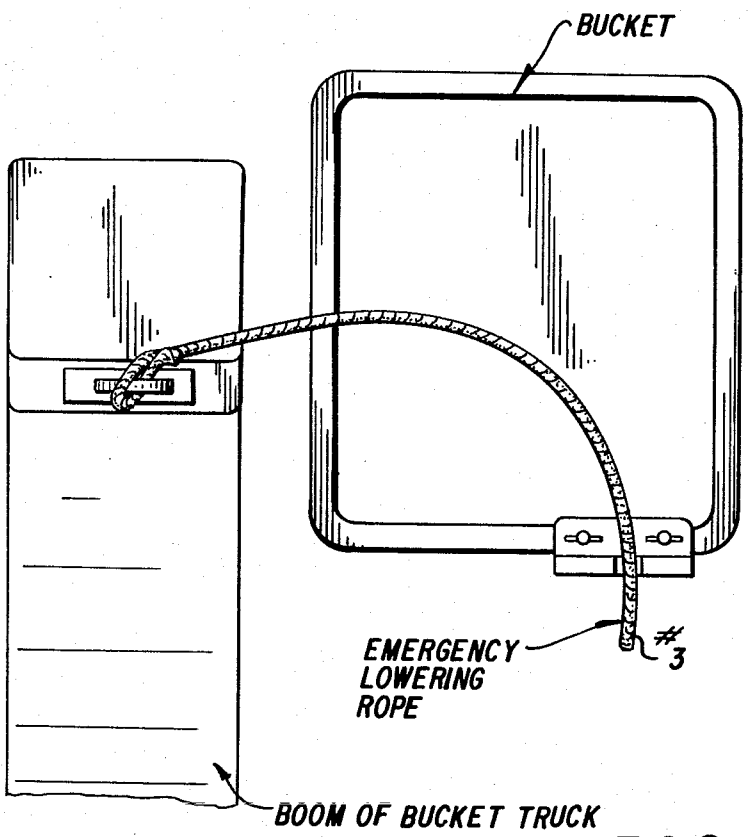
FIG. 2 is a top view of a bucket on a bucket truck, showing the bucket and the boom of the bucket truck, with the emergency lowering rope being utilized in conjunction with the direction altering device.
Figure 4:
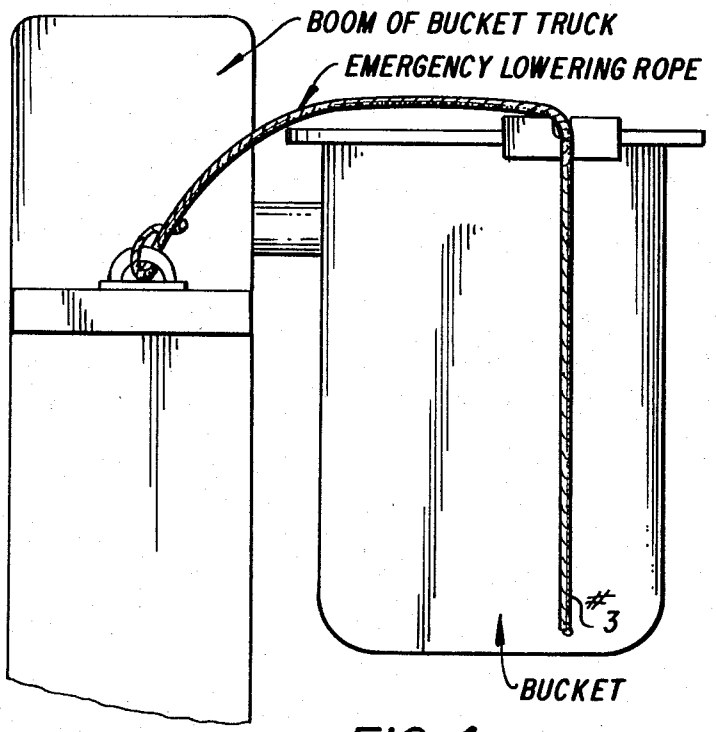
FIG. 4 is a side view of a bucket on a bucket truck, showing the bucket and the boom of the bucket truck, with the emergency lowering rope being utilized in conjunction with the direction altering device.

FIG. 2 and FIG. 4 show that when the emergency lowering rope is securely positioned in the direction altering device, the rope will not slide off the edge of the bucket onto the side of the boom or other obstacle, but will remain at position #3. The exiting individual is thus provided with a clear emergency exit path to the ground.

Figure 5:
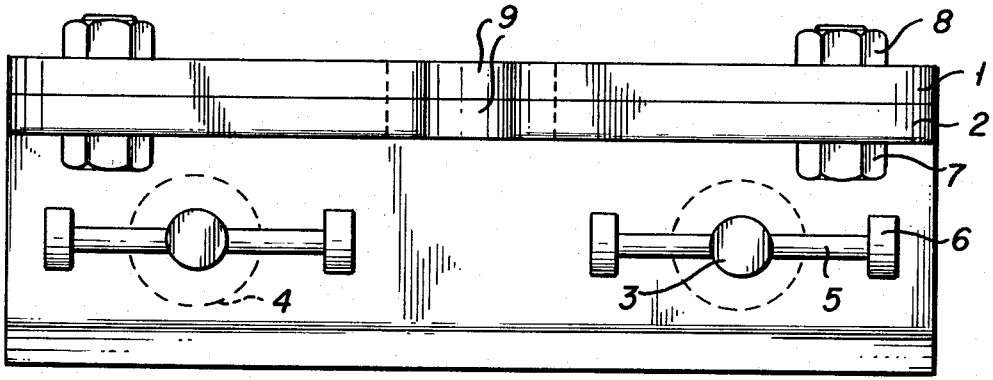
FIG. 5 is a top view of a preferred embodiment of this invention.
Figure 7:
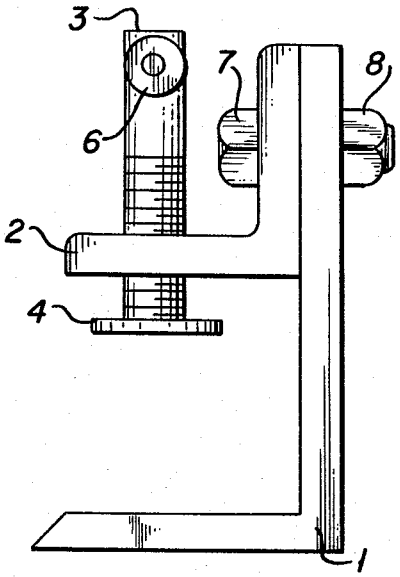
FIG. 7 is an end view of a preferred embodiment of this invention.
Figure 6:
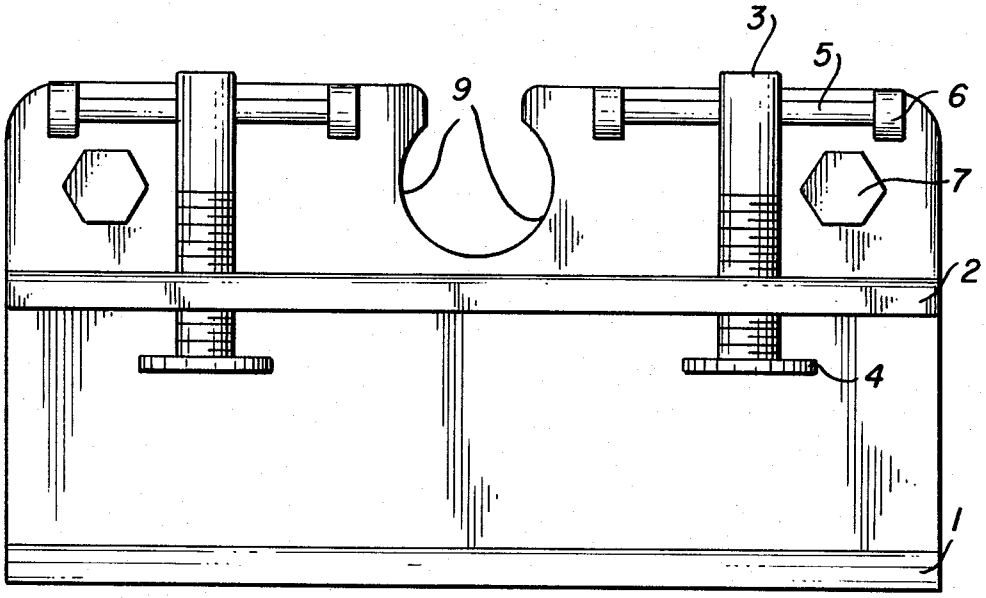
FIG. 6 is a side view of a preferred embodiment of this invention.

FIGS. 5, 6, and 7 show a particular preferred embodiment, where the base plate (1) comprises both the base panel and one of the side panels. To the base plate (1) is attached a top plate (2), comprising the other side panel. The base plate (1) and the top plate (2) together form a channel into which is placed the surface on which the device is mounted. The base plate (1) and the top plate (2) are joined together by a pair of bolts (7) and nuts (8). Formed in the upper portions of the base plate (1) and the top plate (2), which together form the extension of the base panel, is a slotted hole (9), having a smooth surface and rounded edges, through which the emergency lowering rope passes.

Figure 9:
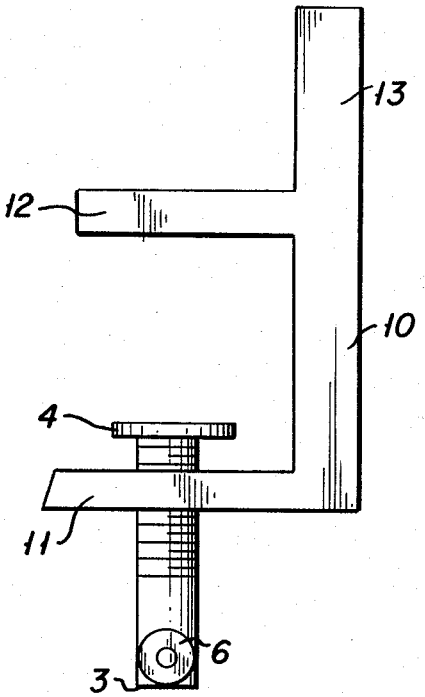
FIG. 9 is an end view of another alternative preferred embodiment of this invention.

Passing through threaded holes in the top plate (2) are mounting screws (3), which are employed to tighten the device onto the mounting surface. In this embodiment, two mounting screws (3) are shown; obviously, one or more mounting screws could be used. The mounting screws could, alternatively, pass through the opposite side panel, as shown in FIG. 9. The mounting screws (3) are provided with swivel ends (4), which bear on the mounting surface. The turn handles (5) pass through holes in the mounting screws (3) and allow a great deal of leverage to be applied to the mounting screws (3), in the tightening and loosening operation. The turn handles (5) slide back and forth freely through the holes in the mounting screws (3) to allow them to pass the top plate (2) and to provide additional leverage, when the mounting screws (3) are turned. The ends of the turn handles (5) are fitted with caps (6) at their ends to keep the turn handles (5) from dropping out of the holes in the mounting screws (3) and thus becoming lost.

Figure 8:
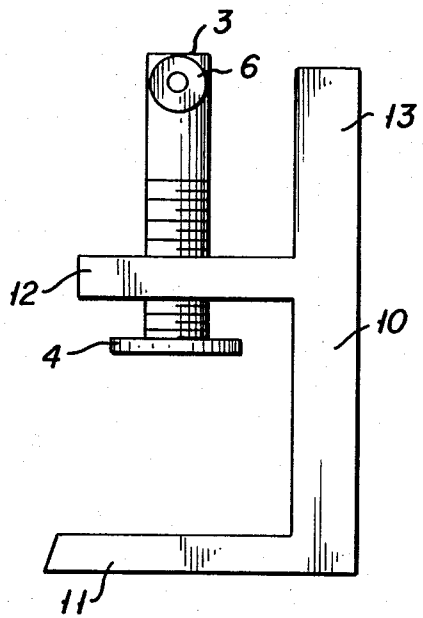
FIG. 8 is an end view of an alternative preferred embodiment of this invention.

FIG. 8 and FIG. 9 illustrate alternative embodiments where the base panel (10), first side panel (11), second side panel (12), and base panel extension (13) are all cast as a single unit. In FIG. 8, the mounting screws (3) pass through the second side panel (12). In FIG. 9, the mounting screws (3) pass through the first side panel (11).

It is to be understood that the invention is not limited to the illustrations described and shown herein, which are deemed to be merely illustrative of the best modes of carrying out the invention, and which are susceptible to modification of form, materials, size, number of mounting screws, arrangement of parts and details of operation. The invention rather is intended to encompass all such modifications which are within its spirit and scope as defined by the claims.

What is claimed is:

1. An apparatus for holding a rope or cable in a fixed position on a mounting surface which comprises:

a base panel having an upward extension;

a first side panel;

a second side panel;

said first and second side panels parallel to each other and each lying in a horizontal plane, said base panel and upward extension lying in a vertical plane;

said first side panel having its rear edge connected to the bottom edge of said base panel and said second side panel having its rear edge connected to the said base panel, so that the said three panels form a channel, into which said mounting surface may be inserted, with the said base panel having a connected upward base panel extension beyond the area of connection of the second side panel with the said base panel;

said upward base panel extension having a slot or groove in the top edge of said upward base panel extension, said slot or groove having such form that a rope or cable may pass through it;

tightening means mounted in one of the side panels and being movable in a plane perpendicular to the planes of the said side panels, so that when said mounting surface has been inserted into the said channel formed by the said three panels, the said tightening means can be moved so that it bears against one side of the mounting surface and causes the other side panel to bear against the other side of the said mounting surface, resulting in a secure attachment of the said apparatus with the said mounting surface.

2. An apparatus according to claim 1 wherein said tightening means comprises one or more cylinders grooved in an advancing spiral, each said cylinder fitted in a hole equipped with a spiral groove, compatible with the spiral groove on said cylinder, on its inner surface, each said hole located in one of the said side panels.

3. An apparatus according to claim 1 wherein said base panel, with a portion of its said upward extension having said slot or groove in its upper edge, and said first side panel comprise a first member having an L-shaped cross section, and wherein said second side panel and a portion of said upward base panel extension having said slot or groove in its upper edge, at a location on its said upper edge which coincides with the location of and is of such shape and size as the said slot or groove on the said upper edge of the said first member, comprise a second member having an L-shaped cross section, wherein said two members are connected to form said channel and said upward base panel extension, with the said slot or groove in its upper edge, and wherein said tightening means comprises one or more cylinders grooved in an advancing spiral, each said cylinder fitted in a hole equipped with a spiral groove, compatible with the spiral groove on said cylinder, on its inner surface, each said hole located in one of the said side panels; each said cylinder having a rod inserted in a hole passing through said cylinder at a right angle to the axis of said cylinder, for the purpose of providing additional leverage in turning said cylinder, with each said rod having end fixtures of larger diameter than the said hole in the cylinder to prevent said rod from falling out of said hole in the cylinder; each said cylinder having on its end, which bears on the said mounting surface, an end fixture of larger diameter than that of the said cylinder.

* * * * *